United States Patent [19]

Jennings

[11] 4,121,637

[45] Oct. 24, 1978

[54] TOTE BOARD

[76] Inventor: Russell A. Jennings, P.O. Box 1408, Wichita Falls, Tex. 76306

[21] Appl. No.: 816,939

[22] Filed: Jul. 19, 1977

[51] Int. Cl.[2] ..... A45C 3/02

[52] U.S. Cl. ..... 150/1.6; 150/35; 190/42

[58] Field of Search ..... 150/1.6, 3, 12, 28 R, 150/33, 35, 42; 190/42, 60; 206/214, 371; 24/67 R, 67.11, 67.5, 11 PP; 312/231

[56] References Cited

U.S. PATENT DOCUMENTS

| | | | |
|---|---|---|---|
| 1,627,224 | 5/1927 | Asherman | 150/35 |
| 2,886,085 | 5/1959 | Sanger | 150/1.6 |
| 2,926,405 | 3/1960 | Moesch | 24/67.5 |
| 3,078,897 | 2/1963 | Rifkin | 150/1.6 X |
| 3,335,941 | 8/1967 | Gatward | 150/12 X |
| 3,977,744 | 8/1976 | DeWitt | 206/214 X |

*Primary Examiner*—Donald F. Norton
*Attorney, Agent, or Firm*—M. Ted Raptes

[57] ABSTRACT

A device comprising a combined clipboard and flexible storage pouch with closure means. The clipboard has a conventional flexible clip in its face and has the pouch secured to the rear side thereof for storage and carrying of various articles. The pouch is secured peripherally to the rear of the clipboard and a coplanar member secured to the rear of the clipboard.

7 Claims, 3 Drawing Figures

TOTE BOARD

BACKGROUND OF THE INVENTION

This invention relates generally to clipboards and more particularly to a combined clipboard and pouch means for carrying a plurality of useful articles required by schoolchildren, etc. Clipboards are, of course, well known and are useful for, among other things, securing papers, etc. on a versatile portable writing surface. The present invention extends the versatility of clipboards by providing storage and carrying means for various articles.

BRIEF DESCRIPTION OF THE INVENTION

It is among the principal objects of the present invention to provide an improved clipboard device combined with container means for carrying and storing articles.

Another object of this invention is to provide a clipboard device combined with flexible pouch means secured to the rear of the clipboard device for carrying and storing articles.

A further object of this invention is to provide a device comprising a clipboard combined with flexible container means having closure means.

An additional object of this invention is to provide a clipboard integrally combined with flexible container means and a handle for carrying the clipboard device.

A further feature of the combined clipboard with the carrying and storage pouch means is its easy portability and versatility in that it can be used as a clipboard when desired and can also be used for carrying articles.

DETAILED DESCRIPTION OF THE INVENTION

Figure 1:
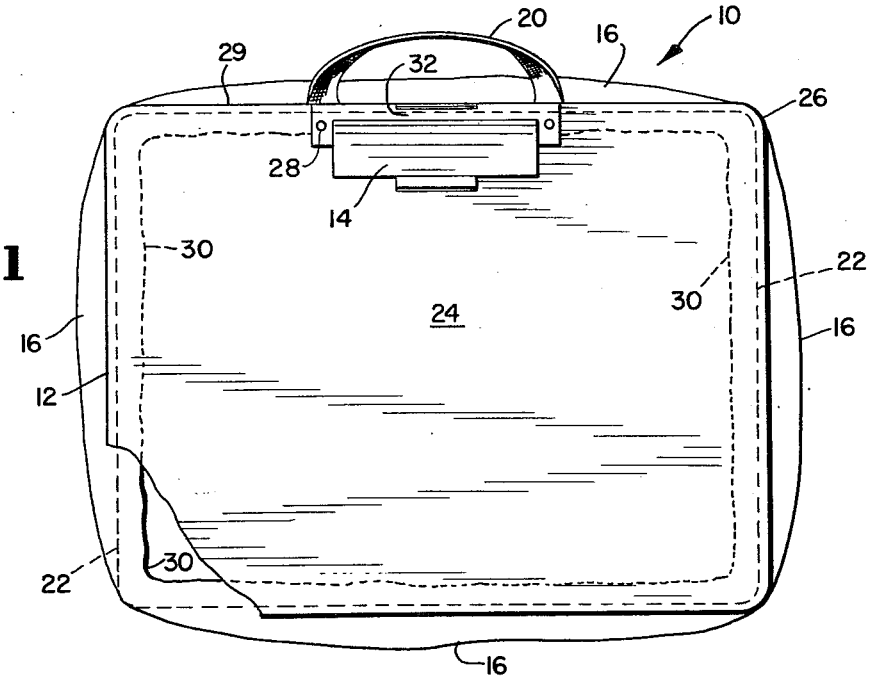
FIG. 1 is a side plan view of the combined clipboard and container showing the clipboard side of the device.
Figure 2:
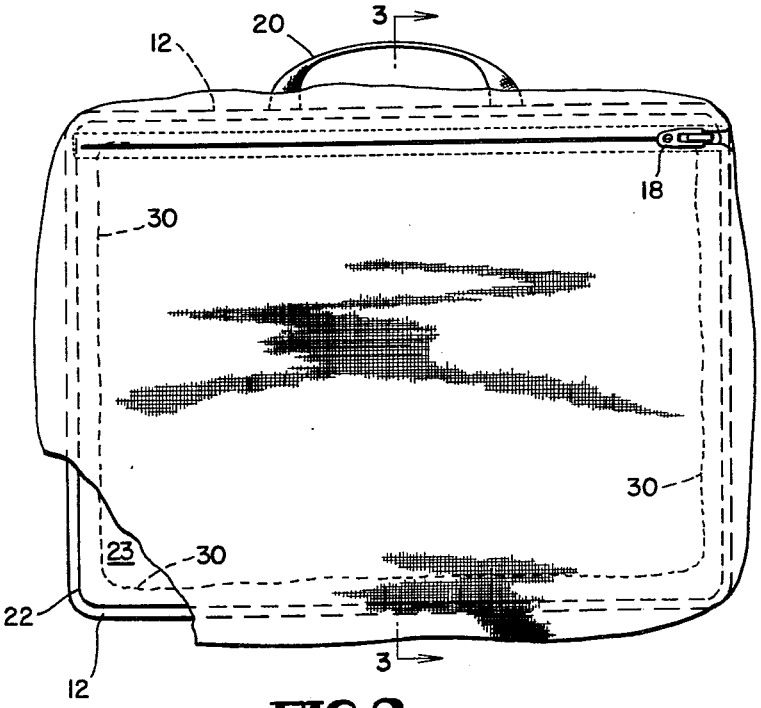
FIG. 2 is a side plan view of the combined clipboard and container showing the container side of the device.

Referring to the drawings, the numeral 10 generally denotes an embodiment of the portable device of the invention which comprises broadly a rectangular planar member 12 with a resilient clip member 14, a flexible pouch 16 and a carrying handle 20.

The rectangular planar member 12 is of minimum thickness and has a hard, suitable, writing surface 24 and rounded corners 26. The member 12 can be of wood, plastic, or metal and has a conventional resilient clip member 14 suitably secured as by rivets 28 along the upper edge 29 at a midportion thereof. Clip member 14 is adapted to retain a writing pad, pamphlet, or the like on surface 24. A recess 32 is adapted for storing a pencil or pen.

Figure 3:
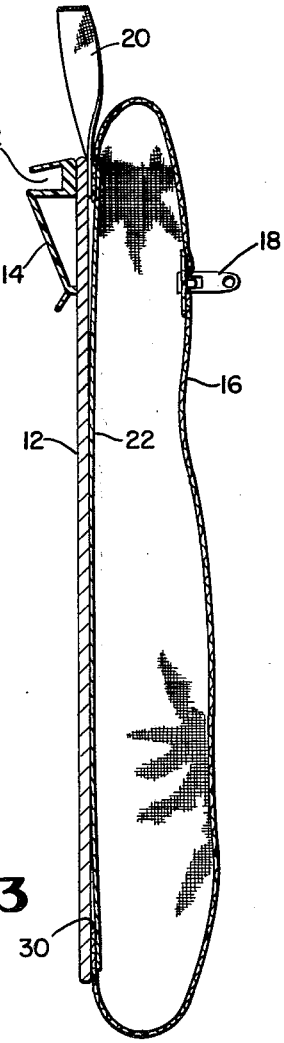
FIG. 3 is a sectional view taken along line 3—3 of FIG. 2.

The opposite side of the device 10 comprises a flexible pouch 16 which is secured to the rear side of the planar member 12 by any suitable means. As shown in the embodiment 10, the peripheral edges 30 of the pouch are sandwiched between member 12 and a coplanar rectangular member 22, which has slightly smaller rectangular dimensions than member 12. In constructing the device, the coplanar member 22 is secured by suitable means such as with an adhesive to the rear side of member 12 while at the same time the peripheral edges 30 of the pouch are sandwiched peripherally therebetween and also secured by suitable means such as with an adhesive as shown in FIG. 3.

A carrying handle 20 is also provided and is secured to the top edge 29 by any suitable means. The handle 20 can be rigid or flexible of a plastic or frabric material. In the embodiment a flexible fabric material comprises the handle, and the ends thereof are sandwiched and secured by suitable means between members 12 and 22 as shown in FIG. 3.

Pouch 16 being flexible is normally collapsed against face 23 of member 22. Suitable closure means are provided along the top edge of the pouch. As shown in the embodiment, zipper means 18 are sewn into the pouch and provide access to and closure means for the storage area provided by the pouch. It is also contemplated that other closure means can be used such as snaps, etc. The pouch as shown is a flexible suitable fabric material. However, the pouch can be made from any type of flexible or semi-rigid material such as plastic, leather, etc.

The device of the invention provides a practical inexpensive combined clipboard and storage pouch which can conveniently be carried. It is particularly useful by schoolchildren for carrying their schoolbooks, pencils, lunch, etc. It is also useful by people moving about who make notes on a clipboard and who also need a place to store, when not needed, various articles such as pencils, hand calculators, cameras, etc.

It is understood that the invention is not limited to the precise details of structure as shown in the embodiment of the invention and set forth in this specification, because other modifications within the scope of this invention will occur to those skilled in the art to which the invention pertains.

What is claimed is:

1. A portable device comprising a combined clipboard including a flexible clip on its outer face and a storage pouch secured to the rear of said clipboard, said pouch including closure means and access into the storage area of said pouch, a coplanar slightly smaller member secured to the rear of said clipboard, the periphery of said pouch sandwiched and secured between the peripheries of said clipboard and said coplanar member, handle means for carrying the device, the ends of said handle sandwiched and secured between said clipboard and said coplanar member.

2. The portable device of claim 1, wherein said handle means comprises a flexible fabric material.

3. The portable device of claim 1, wherein said pouch is a flexible fabric material.

4. The portable device of claim 1, wherein said closure means is a zipper.

5. A portable device comprising combined writing surface means and storage means, said writing surface means comprising a planar clipboard member which includes a flexible clip on its outer face and a coplanar slightly smaller second planar member secured to the rear face of said clipboard means, said storage means comprising flexible pouch means having the periphery thereof secured and sandwiched between the peripheries of said clipboard member and said second planar member, said storage means including access means into the storage area of said pouch, and closure means for said access means.

6. The portable device of claim 5, wherein said device comprises handle means for carrying the device, the ends of said handle sandwiched and secured between said clipboard member and said second planar member.

7. The portable device of claim 6, wherein said flexible pouch is a fabric material, said handle means is a fabric material, and said closure means is a zipper.

* * * * *